US005168806A

United States Patent [19]

Reder et al.

[11] Patent Number: 5,168,806

[45] Date of Patent: Dec. 8, 1992

[54] INKING UNIT HAVING CHAMBERED DOCTOR BLADE

[75] Inventors: Wolfgang O. Reder, Veitshöchheim; Georg Schneider, Würzburg, both of Fed. Rep. of Germany

[73] Assignee: Koenig & Bauer AG, Wurzburg, Fed. Rep. of Germany

[21] Appl. No.: 679,284

[22] Filed: Apr. 2, 1991

[30] Foreign Application Priority Data

Apr. 23, 1990 [DE] Fed. Rep. of Germany ..... 4012825

[51] Int. Cl.[5] ..... B41F 31/02

[52] U.S. Cl. ..... 101/366; 118/261; 118/410; 118/413

[58] Field of Search ..... 101/363, 364, 365, 366, 101/380, 157, 169; 118/126, 259, 261, 413, 410

[56] References Cited

U.S. PATENT DOCUMENTS

| | | | |
|---|---|---|---|
| 3,863,597 | 2/1975 | Anselrode | 118/126 |
| 4,008,664 | 2/1977 | Crum et al. | 101/365 |
| 4,958,561 | 9/1990 | Grosshauser et al. | 101/363 |
| 5,005,476 | 4/1991 | Köbler et al. | 101/363 |

FOREIGN PATENT DOCUMENTS

| | | |
|---|---|---|
| 3704433 | 1/1989 | Fed. Rep. of Germany . |
| 3838546 | 7/1989 | Fed. Rep. of Germany . |
| 3800411 | 3/1990 | Fed. Rep. of Germany . |

*Primary Examiner*—Edgar S. Burr
*Assistant Examiner*—Moshe I. Cohen
*Attorney, Agent, or Firm*—Jones, Tullar & Cooper

[57] ABSTRACT

An inking unit uses circumferentially offset elongated flexible doctor blades to form an ink chamber into which the screened surface of an ink roller immerses itself. Free ends of the spaced flexible doctor blades can be forced into or out of contact with the screened roller surface in accordance with the pressure of the ink in the ink chamber.

9 Claims, 1 Drawing Sheet

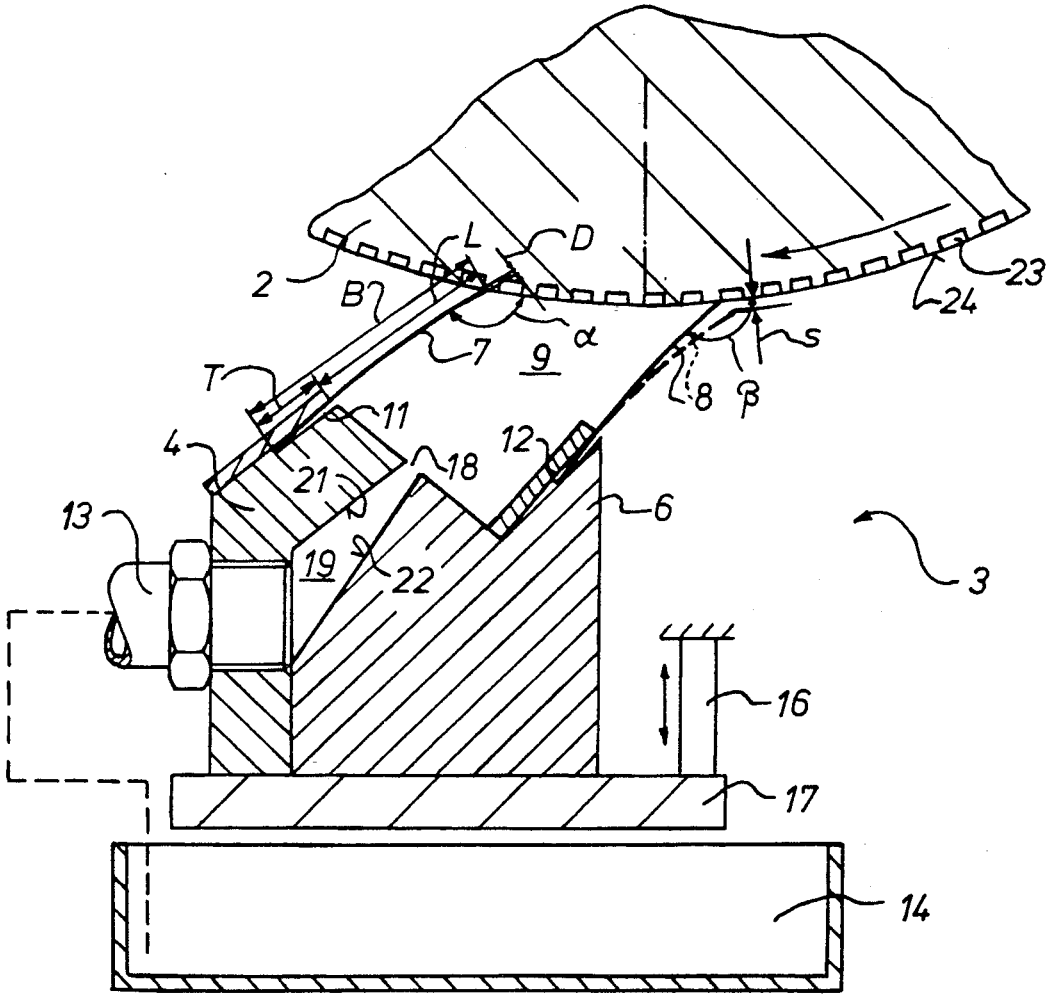
2
L
D
B
7
9
α
23
24
s
T
8
β
11
4
12
18
21
6
13
19
22
3
16
17
14

INKING UNIT HAVING CHAMBERED DOCTOR BLADE

FIELD OF THE INVENTION

The present invention is directed generally to an inking unit. More particularly, the present invention is directed to an inking unit for a screened ink roller in a printing press. Most specifically, the present invention is directed to an inking unit having an ink chamber formed using two spaced flexible doctor blades. The two doctor blades are supported in a blade holder and are positioned circumferentially spaced from each other and in abutting relation to the screened surface of the ink roller. The two spaced doctor blades, together with the blade holder and spaced side plates, define the ink chamber into which the screened surface ink roller is immersed.

DESCRIPTION OF THE PRIOR ART

Various inking fountains and inking units which are intended for use with a rotary ink roller are generally known in the art. In these inking units there is often provided at least one doctor blade which forms one wall of the inking unit. The doctor blade typically engages, and rides on the surface of the rotating ink roller. In the case of a screened surface ink roller, the doctor blade is often used to remove excess ink from the surface of the roller so that only the ink which is carried in the cells of the roller is carried away from the inking fountain or ink holder.

One prior art inking unit is shown in German published, unexamined, patent application No. 3800411. In this prior device there is provided an inking unit having a sealing doctor blade that has at least one overflow opening. This overflow opening is used to connect the ink chamber in the inking unit with an additional ink prechamber. This allows the positive ink pressure in the ink chamber to be controlled. The ink pressure in the ink chamber can thereby be reduced when it becomes too high. The ink which overflows is fed back to a pump so that an ink flow path or circuit is produced.

The prior art inking units are apt not to be able to rapidly compensate for changes in ink pressure in the ink chamber. These ink pressure changes can result from the inclusion of air bubbles in the ink and from changes in ink viscosity. Further, the prior art devices often have been unable to reduce the ink pressure evenly over the length of the ink chamber. Uneven ink pressures give rise to defects in the products being printed.

The prior art inking units have not provided a chambered doctor blade assembly that can compensate for pressure fluctuations in the ink chamber. This has led to inking irregularities and to reduced printing quality. The inking unit having a chambered doctor blade in accordance with the present invention, as will be discussed subsequently, overcomes the limitations of the prior art devices and is a substantial improvement over these prior art devices.

SUMMARY OF THE INVENTION

It is an object of the present invention to provide an inking unit.

Another object of the present invention is to provide an inking unit for a screen surface ink roller for a printing press.

A further object of the present invention is to provide an inking unit having a chambered doctor blade.

Still another object of the present invention is to provide an inking unit which compensates for pressure fluctuation in the ink chamber.

Yet a further object of the present invention is to provide an inking unit having spaced doctor blades.

Even still another object of the present invention is to provide an inking unit having two circumferentially spaced doctor blades.

Still yet a further object of the present invention is to provide an inking unit having a chambered doctor blade in which the blades have a height that is large in comparison to their thickness.

As will be discussed in detail in the description of the preferred embodiment which is set forth subsequently, the inking unit in accordance with the present invention utilizes two spaced flexible doctor blades which engage the screened surface of the ink roller. These blades define an ink chamber into which the surface of the screened ink roller is immersed. The blades, since they are flexible, can compensate for fluctuation in the ink pressure in the ink chamber. The flexibility of the two peripherally spaced doctor blades also minimizes wear on the surface of the screen surface ink roller while ensuring that the ink cells of the screened ink roller are evenly filled with ink.

Pressure fluctuations in the ink chamber are decreased by the present invention. This reduction in pressure fluctuation decreases the formation of unwanted air bubbles. These air bubbles have, in prior art devices, impaired the filling of the cells on the surface of the screened ink fountain rollers.

The use of the two spaced flexible blades to form the chambered doctor blade of the inking unit of the present invention provides an overflow opening for excess ink in the ink chamber. The overflow opening is operative in response to any increase in pressure in the ink fountain. This ink pressure increase, which may be caused by a change in the viscosity of the ink, by a change in the speed of rotation of the screened ink roller or by other causes, is compensated for by the flexible doctor blades. This reduces any over-pressurization of the ink fountain in an even manner which ensures that the pressure along the entire length of the ink chamber will be reduced evenly. Such an even reduction in pressure means that an uneven application of ink to differing areas of the print carrier, which results in the production of visible longitudinal streaks on the printed matter, will be avoided.

The ink is supplied to the ink chamber formed by the spaced doctor blades through an elongated ink slot. This elongated ink slot extends across the entire length of the ink chamber. Thus even the ink cells at the outer ends of the screened ink roller are provided with ink. The ink supply slot also aids in the creation of an even ink supply pressure along the length of the ink chamber.

The housing of the inking unit is preferably formed as two separate elements. Each element supports one of the doctor blades that make up the chambered doctor blade of the present invention. The use of this two-part housing provides a simple structure and also provides the ink supply slot that extends along the length of the inking unit.

The inking unit having a chambered doctor blade in accordance with the present invention, provides an assembly that automatically compensates for variations in ink chamber pressure and provides a uniform ink pressure along the length of the chamber. It overcomes the limitations of the prior art devices and is a significant advance in the art.

BRIEF DESCRIPTION OF THE DRAWING

While the novel features of the inking unit having a chambered doctor blade in accordance with the present invention are set forth with specificity in the appended claims, a full and complete understanding of the invention may be had by referring to the detailed description of the preferred embodiment as is set forth subsequently, and as illustrated in the accompanying sole drawing FIGURE, which is a schematic side elevation view, partly in section, of an inking unit having a chambered doctor blade in accordance with the present invention.

DETAILED DESCRIPTION OF THE PREFERRED EMBODIMENT

As may be seen in the sole drawing FIGURE, an inking unit having a chambered doctor blade in accordance with the present invention is shown generally at 3. Inking unit 3 is intended for use in a rotary printing press to supply ink to a surface of a screened ink roller 2. The inking unit 3 is adjustably positioned to contact the underside of the screened ink roller 2. The inking unit 3 is comprised of two cooperating blade holders 4 and 6 whose structure will be discussed in detail subsequently. This blade holder assembly, which is comprised of blade holders 4 and 6, is divided along a line parallel to the axis of rotation of the screened ink roller 2.

A pair of elongated, flexible doctor blades 7 and 8 are carried by the blade holders 4 and 6. These doctor blades 7 and 8 are generally parallel to each other and also extend generally parallel to the axis of rotation of the screened surface ink roller 2. These two blades 7 and 8 are also spaced or offset from each other about the circumference of the screened surface ink roller or in the circumferential direction of rotation of the roller 2.

The blade holders 4 and 6, together with the circumferentially offset blades 7 and 8, and further with suitable side plates (not shown), form an ink chamber 9 into which the screened surface ink roller immerses as it rotates. It will be understood that several adjacent chambered doctor blade assemblies 3 can be positioned along the length of the ink fountain roller 2. The usage of several such adjacent chambered doctor blade assemblies 3 provides increased flexibility for the press assembly. For example, the ink supply to one zone of the screened surface ink roller 2 may be shut of. In a similar manner, different inks can be supplied to adjacent chambered doctor blade assemblies 3 and hence to various zones of the screened surface ink roller 2.

Referring again to the sole drawing FIGURE, the first flexible elongated blade 7 may be referred to as the stripping-off blade while the second flexible elongated blade 8 may be referred to as the sealing blade. Each of these blades 7 and 8 is positioned in its blade holder 4 or 6, respectively, to have a contact angle $\alpha$ or $\beta$ with respect to the surface of the screened ink roller 2 which is greater than 90°. The free ends of the two doctor blades 7 and 8 are brought into contact with the surface of the ink roller 2 under a slight pressure, as will be discussed subsequently. Each of the blades 7 and 8, which may be made of a flexible material such as steel or polycarbonate, has a length that is approximately the same as the length of the ink chamber 9. The height or width B of each blade 7 or 8 is quite great with respect to the thickness. In a preferred configuration, each blade may have a width B of generally about 50 mm. and a thickness D of generally about 0.1 mm. Each of the blades 7 and 8 is positioned in a cooperating notch or groove 11 or 12 which is formed on the respective blade holder 4 or 6. The depth T of each such notch is preferably about 10 mm. This allows each flexible blade 7 or 8 to have a free or bending width or height L of about 40 mm. The resultant free bending height L to thickness D ratio of about 400 results in a very flexible doctor blade 7 or 8.

Elongated flexible doctor blades 7 and 8 react very quickly to changes in ink pressure in the ink chamber 9. The flexible blades 7 and 8 will be bent or flexed to a greater or lesser degree depending on the ink pressure in the ink chamber 9. An increase in pressure in the ink chamber 9 may be caused by a change in ink viscosity or by the production of air bubbles in the chamber 9. Whatever the cause, this increase in ink pressure is apt to give rise to a problem since the ink in the chamber 9 may not completely fill all of the cells 23 on the surface of the screened surface ink roller 2. The failure of all of the cells 23 to be filled with ink may well lead to a deterioration in the quality of the ink distribution accomplished by the ink roller 2.

An increase in pressure in the ink chamber 9 will press the free end of the first or stripping-off doctor blade 7 with greater force against the surface of the screened surface ink roller 2. This increase in pressing force is proportional to the increase in pressure of the ink in the ink chamber 9. Increasing the pressing force of the stripping-off blade 7 against the surface of the ink roller 2 will be apt to result in removal of ink that has been supplied from ink chamber 9 to the surface cells 23 of the ink roller 2. If the pressure in the ink chamber 9 is reduced, the contact force of the free end of the stripping-off blade 7 against the ink roller 2 will be reduced. This reduction in contact pressure between the blade 7 and the roller 2 reduces the wear on the end of the blade 7 and also reduces wear on the cross-pieces 24 of the ink roller 2. This reduction in wear lengthens the operating life of both the blade 7 and the screened surface ink roller 2.

While the first or stripping-off blade 7 is pressed against the roller 2 with greater force due to an increase in the ink pressure in ink chamber 9, the second or sealing doctor blade 8 is forced out of contact with the surface of the screened ink roller 2 with an increase in ink pressure in ink chamber 9. As is shown in the sole drawing FIGURE, this increase in pressure in the ink chamber 9 will force the free end of the sealing doctor blade 8 to separate from the surface of the screened surface ink roller 2. This separation creates a small gap S of between 0.0 mm. and 0.5 mm. between the free end blade edge and the surface of the ink roller 2. Ink in the ink chamber 9 can now flow out of chamber 9 through this gap S at a rate at least equal to, and possibly greater than, the rate of ink flow into chamber 9. This ink outflow will continue as long as the ink pressure in ink chamber 9 is sufficiently high to hold the gap S open. The ink which flows out through gap S, in combination with the ink carried out of ink chamber 9 in the cells 23 of the ink roller 2, together with the ink retained in the ink chamber 9, equals the amount of ink supplied to the ink chamber through an ink supply line 13. If the supply through ink supply 13 to ink chamber 9 exceeds the ink removed by the cells 23 of the ink roller 2, the excess will exit the ink chamber 9 through the gap S. In this way, the sealing blade 8 acts as a type of pressure control valve which operates evenly over the entire length of the ink chamber 9.

The surplus ink which exits through the gap S will be collected in an ink container 14 that underlies the chambered doctor blade assembly 3. This excess ink can be pumped by a suitable pump (not shown) back to the ink chamber 9 to thereby create an inking circuit. Additional new ink can be added to this inking circuit as required. When the pressure in the ink chamber 9 decreases, the flexible sealing doctor blade 8 will spring or move back toward an abutting engagement with the ink roller 2 by an amount proportional to the reduction in ink pressure. When the ink pressure has been sufficiently reduced, the free end of the sealing doctor blade 8 will contact the ink roller 2 with a slight tension caused by the inherent resiliency of the material used to make doctor blade 8.

The two elongated flexible doctor blades 7 and 8 may be brought into initial contact with the ink roller 2 with an adjustable pressure. The two blade holders 4 and 6 are supported on a vertically adjustable base plate 17. Any suitable means, such as mechanical, electromagnetic, pneumatic or hydraulic means may be used to raise or lower the base plate 17 and its supported blade holders 4 and 6. An adjustable stop 16 is attached to the frame of the assembly and is used to stop the upward movement of the base plate 17. By varying the position of adjustable stop 16, the contact forces between the free ends of the first and second doctor blades 7 and 8 with the ink roller 2 can be adjusted.

Again referring to the sole drawing FIGURE, the first blade holder 4 and the second blade holder 6, which make up the blade holder assembly are secured together by any suitable means not specifically shown. The blade holder assembly includes an elongated ink supply slot 18 that feeds ink from the ink supply line 13 to the ink chamber 9 This elongated ink supply slot 18 also extends along the entire length of the ink chamber 9 so that the pressure of the ink in the ink supply chamber 9 will be equal along the entire length of the chamber 9. The ink supply slot 18 receives ink from an elongated ink distributing chamber 19 that is in fluid communication with the ink supply connection 13.

The two blade holder elements 4 and 6 are joined to each other along the longitudinal direction of the ink chamber 9. A first undercut surface 21 of the first blade holder element 4 cooperates with a second undercut surface 22 of the second blade holder element 6 to define the ink distributing channel 19 and to give it a shape which is generally triangular in cross section. These two undercut surfaces 21 and 22 do not contact each other and thus form ink supply slot 18.

While a preferred embodiment of an inking unit having a chambered doctor blade in accordance with the present invention has been set forth fully and completely hereinabove, it will be apparent to one of skill in the art that a number of changes in, for example, the number of inking units used, the overall size of the screened surface ink roller, the means utilized to secure the two blade holder elements together and the like, may be made without departing from the true spirit and scope of the invention and that the invention is to be limited only by the following claims.

What is claimed is:

1. An inking unit having a chambered doctor blade assembly for a rotary press including a screened surface ink roller, said inking unit comprising:

an elongated blade holder assembly positioned adjacent the screened surface ink roller, said blade holder assembly having first and second cooperating doctor blade holders;

a first elongated flexible stripping doctor blade supported in said first doctor blade holder;

a second elongated flexible sealing doctor blade supported in said second doctor blade holder, said first and second elongated flexible doctor blades being generally parallel to each other and being positioned offset to each other in a circumferential direction of the screened surface ink roller;

an elongated ink chamber, said ink chamber being defined by said first and second spaced, generally parallel flexible doctor blades and said first and second doctor blade holders;

each of said first and second doctor blades having a free first end, said free first ends of said first and second doctor blades being engageable with a peripheral surface of the screened ink roller means to provide rapid pressure relief for said ink chamber, said means including mounting said first and second doctor blades with generally similar first and second contact angles, said first contact angle causing said free first end of said first stripping doctor blade to engage the peripheral surface of the screened ink roller with a greater force in response to increased ink pressure in said ink chamber, said second contact angle causing said first free end of said second sealing doctor blade to be forced out of contact with the peripheral surface of the screened ink roller in response to increased ink pressure in said ink chamber thereby quickly relieving said chamber of excess pressure; and each of said first and second doctor blades having a free bending height which is greater than a thickness of each said blade.

2. The inking unit of claim 1 wherein said first and second generally similar contact angles are greater than 90°.

3. The inking unit of claim 1 wherein said ink chamber receives ink from an elongated ink supply slot having a length generally the same as said elongated ink chamber.

4. The inking unit of claim 3 having an ink distributing chamber, said ink distributing chamber distributing ink from an ink supply means to said ink supply slot.

5. The inking unit of claim 1 further including a movable base plate and an adjustable stop and wherein said elongated blade holder assembly is supported by said base plate and further wherein said base plate is movable into contact with said adjustable stop.

6. The inking unit of claim 1 further including an ink container, said ink container being positioned beneath said elongated blade holder assembly and being in fluid communication with said elongated ink chamber.

7. The inking unit of claim 1 wherein each of said first and second elongated flexible doctor blades has a thickness of generally 0.1 mm.

8. The inking unit of claim 7 wherein each of said first and second elongated flexible doctor blades has a free bending height of generally 40 mm.

9. The inking unit of claim 8 wherein each of said first and second elongated flexible doctor blades has a free bending height to thickness ratio of generally 400 to 1.

* * * * *